US006014828A

United States Patent [19]

Kern et al.

[11] Patent Number: 6,014,828

[45] Date of Patent: Jan. 18, 2000

[54] COMBINATION ADVERTISING AND WARNING SIGN FOR SHELVING

[76] Inventors: Bruce R. Kern, Suite 390, Jacksonville, Fla. 32256; Don Ladson, 9714 Underwood Ct., Jacksonville, Fla. 32221; Lewis G. Libby, Suite 390, Jacksonville, Fla. 32256

[21] Appl. No.: 09/235,258

[22] Filed: Jan. 22, 1999

[51] Int. Cl.[7] ..... G09F 7/00

[52] U.S. Cl. ..... 40/492; 40/651; 49/49

[58] Field of Search ..... 40/492, 584, 651; 49/49

[56] References Cited

U.S. PATENT DOCUMENTS

| | | | |
|---|---|---|---|
| 763,603 | 6/1904 | Fuller . | |
| 1,287,196 | 12/1918 | Black . | |
| 1,513,017 | 3/1924 | Thornburgh . | |
| 1,552,920 | 9/1925 | Glover . | |
| 1,592,241 | 7/1926 | Welday . | |
| 5,233,773 | 8/1993 | Reynolds . | |
| 5,560,131 | 10/1996 | Gibson . | |
| 5,722,623 | 3/1998 | Gibson . | |
| 5,915,856 | 6/1999 | Yeranossian | 40/606 |

FOREIGN PATENT DOCUMENTS

| | | | |
|---|---|---|---|
| 77391 | 1/1994 | Germany | 40/492 |
| 13073 | 1/1893 | United Kingdom | 40/492 |

*Primary Examiner*—Cassandra H. Davis
*Attorney, Agent, or Firm*—Thomas C. Saitta

[57] ABSTRACT

A warning sign, having a vertically elongated housing mounted onto shelving with the housing extending a short distance laterally and perpendicularly from the face of the shelving, the housing preferably having advertising or other indicia positioned on opposing face members and a pocket which receives a pivoting warning arm, where the warning arm is hidden within the pocket in the vertical position but can be pivoted into an exposed horizontal position to extend laterally from the shelving to warn customers of hazardous conditions in the aisle. The sign is mounted with a hinged bracket having a non-vertical pivot axis, such that the sign will automatically resume a neutral position perpendicular to the shelving if it is pushed or pulled to either side.

20 Claims, 2 Drawing Sheets

COMBINATION ADVERTISING AND WARNING SIGN FOR SHELVING

BACKGROUND OF THE INVENTION

This invention relates generally to the field of warning signs which can be mounted onto horizontal shelving. More particularly, the invention relates to such signs which are generally vertically oriented, having a significant vertical dimension, a relatively smaller lateral dimension and a relatively thin thickness dimension, and which define a pocket to receive a warning arm which remains hidden within the pocket until pivoted into a horizontal position extending laterally from the sign. Even more particularly, the signs may have means to retain interchangeable advertising, information or other indicia.

In large retail establishments, such as grocery stores, drug stores, hardware stores and the like, the most common manner of displaying goods is to provide numerous horizontally disposed shelves arranged to define a number of generally parallel or perpendicular aisles. A problem often encountered in such establishments, and especially in grocery stores or other stores selling liquid goods, is that customers will accidentally break a container, resulting in the spilled material spreading onto the floor and creating a serious hazard to other customers. In the typical response scenario, a clerk or worker is contacted and shown the spill, the worker then retrieves a stand-alone warning device from storage in the non-public areas of the store, such as a plastic cone or easel board, places the warning device in the area of the spill, retrieves clean-up equipment, cleans up the spill, returns the equipment, then returns the warning devices. Because there can be significant time lapses in this scenario, the spill will often remain unmarked for longer periods than is desired. This results in increased negligence or liability exposure for the stores from possible slip and fall accidents. It would also be desirable to provide an easy and simple warning when the shelves are being restocked, the floors are being waxed or polished, or there is some other impediment in the aisle.

To address this problem, the invention provides a novel warning sign device which can be mounted onto the horizontal shelving at any desired location, and preferably at regular intervals down each aisle. The device defines a pocket which receives a pivotable warning arm, such that the warning arm remains hidden within the device until a spill occurs, at which time the warning arm is pivoted from the pocket to expose a cautionary indicia which extends into the aisle, and possibly to activate a visible signal or an audible signal to draw attention to the warning arm. By providing a relatively large number of warning signs at spaced intervals, a hazardous area can be marked as soon as the store personnel are notified without the delay inherent in seeking out temporary warning devices. In addition, the warning sign device also provides a means to display various indicia, such as the store name, product advertisement, general product headings, special pricing sales information, general consumer information, etc. on the exposed housing when the device is in the passive, non-warning, position.

It is an object of this invention to provide warning means which is mountable onto horizontal shelving, the warning means being generally vertically disposed but extending perpendicularly a small distance into the aisle between adjacent shelves, and which has a pocket to receive a warning arm member marked with cautionary indicia, where the warning arm can be pivoted from the pocket to extend out from the advertising means in the direction across the aisle. It is a further object to provide such a warning means which presents indicia on two sides of the sign housing readily visible to persons using the aisle, where the indicia is easily interchangeable. It is a further object to provide such a warning means where the mounting means is easily adjustable to accommodate various shelve heights and where the mounting means allows the sign to be pivoted from the perpendicular position relative to the shelves but which automatically returns the sign to the perpendicular position after the pivoting force is removed. It is a further object to provide such a warning means where the warning arm also contains an audible or visible signal means which is activated when the arm is pivoted into the extended position to better alert customers approaching the hazardous area.

SUMMARY OF THE INVENTION

The invention is a hazard warning, and preferably a combination hazard warning and advertising sign mounted onto the front edge of horizontally disposed shelving, where the sign comprises a housing which is elongated in the vertical direction, relatively narrow in the lateral direction and thin in the thickness direction, which is mountable onto the horizontal shelving by a shelf mounting bracket which can be adjusted vertically on the sign to allow the sign to be mounted at any chosen height. The mounting means bracket comprises a non-vertically angled hinge or pivot member which allows the sign to pivot to either side and which automatically returns the sign to a position perpendicular to the shelving when the force is removed. When mounted the housing presents a pair of faces which extend perpendicularly from the front edges of the shelving into the aisle, such that an indica mounting surface is presented to a customer approaching the sign from either direction. Preferably, the faces have indicia receiving members which allows the advertising, informational or other indicia to be changed when desired. The two face members define a vertically oriented pocket disposed perpendicular to the face of the shelving which receives and retains a warning arm pivotally mounted therein in a manner such that the warning arm is generally hidden from view. The warning arm may be pivoted from the pocket into a generally horizontal position to extend perpendicularly into the aisle to provide a warning as to hazardous conditions. The warning arm may comprise printed cautionary indicia, visible signals, audible signals, or any combination thereof.

DETAILED DESCRIPTION OF THE INVENTION

Figure 1:
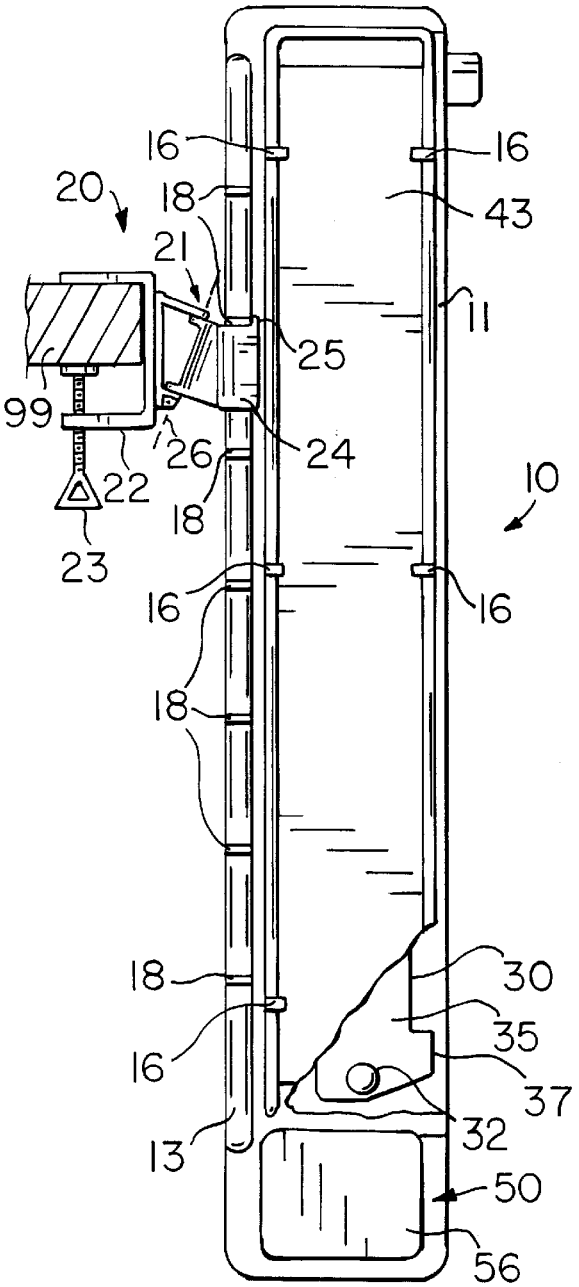
FIG. 1 is a side view of the invention mounted onto shelving, with a portion removed to expose the base of the pivoting warning arm.

With reference to the drawings, the invention will now be described in detail with regard for the best mode and the preferred embodiment. In general, the invention comprises a housing 10 defining a pocket 17, a warning arm member 30 pivotally disposed within pocket 17, and means 20 to mount the housing 10 onto the front edge of shelving 99, where the housing 10 is laterally disposed generally perpendicularly to the face of the shelving 99 so as to extend into the aisle, the face being defined as the plane containing the front edges of the individual shelves 99.

Figure 2:
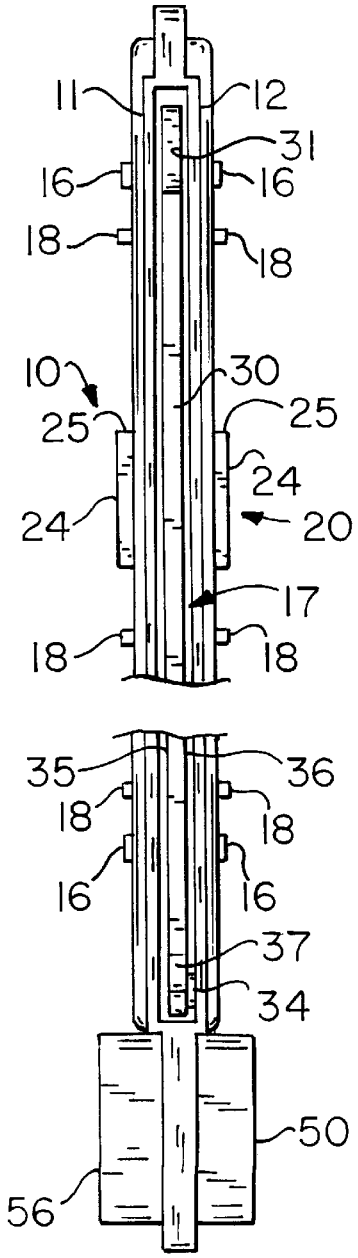
FIG. 2 is an end view of the invention showing the pivoting arm positioned within the pocket.

Referring now to FIGS. 1 and 2, the housing 10 is seen to comprise a generally rectangular first face member 11 and a generally rectangular second face member 12, oppositely disposed in essentially parallel manner and separated by a generally elongated rectangular pocket. The housing 10 is generally elongated in the vertical direction, such that its vertical dimension is significantly greater than its lateral direction, defined as the direction extending generally perpendicularly to the plane containing the front edges or the face of the shelving 99 when the housing 10 is mounted thereon, and the housing 10 is relatively thin in the thickness direction, as seen in the end view of FIG. 2. Dimensions may vary, but as an example housing 10 may be sized approximately 28 inches vertically by 5 inches laterally by 0.5 inches in thickness.

The housing 10 is mounted onto a shelf 99 by shelf mounting means 20, which may comprise any suitable mechanism for connecting the housing 10 to the shelving 99, but is preferably adjustable in the vertical direction such that the mounting means 20 may be positioned at various locations on the mounting flange 13 extending along the back of the housing 10. The mounting flange 13 is preferably generally circular in cross-section and preferably extends over the majority of the vertical length of housing 10. Support flanges 18 are spaced at intervals along the mounting flange 13, and comprise short shoulders or segments which extend in each lateral direction from faces 11 and 12. Alternatively, the shelf mounting means 20 may be affixed directly to housing 10. As shown, shelf mounting means 20 comprises a sign bracket member 24, which is generally U-shaped in cross-section, for encircling and receiving the mounting flange 13 at a desired location between the support flanges 18. Extending upward from the forward edges of bracket 24 are detents 25. The bracket 24 is configured such that the detents 25 extend forward of the flanges 18 on the mounting flange 13, such that a flange 18 seats onto the top of the sign bracket 24 in a manner which precludes removing the housing 10 form the bracket 24 in the forward direction unless the housing 10 is first lifted so that the flange 18 is above the tabs 25. The U-shaped bracket 24 is attached to a pivoting hinge member 21, which is in turn attached to a generally U-shaped shelf bracket member 22 which receives the front edge of shelf 99. The pivot axis 26 of hinge 21 is inclined toward the top of the sign bracket 24 at an angle of approximately 20 degrees from true vertical. Mechanical fastening means 23 is provided in conjunction with shelf bracket 22, such as a thumb screw disposed in a threaded aperture in the shelf bracket 22, which can be tightened against the shelf 99 to fasten the housing 10 onto the shelf 99 in a secure, but removable, manner.

Because the shelf mounting means 20 has hinge 21 aligned non-vertically, the passive or neutral position for the housing 10 will be such that it extends perpendicularly from the face of the shelving 99 to which it is attached. Should the housing 10 or extended warning arm 30 be bumped, pushed or pulled accidentally or intentionally, the housing 10 will pivot relative to the shelving 99 in either direction. This prevents the sign from breaking or becoming dislodged from the shelf 99. Once the force is removed, the weight of the housing 10 will automatically return it to the neutral position perpendicular to the shelf face because of gravity.

The height of the sign 10 relative to the floor is adjustable regardless of the shelf 99 height, since the housing 10 is removable from the mounting means 20. To select the proper height above the floor, the mounting means is attached to a shelf 99. The housing 10 is then removed from the sign bracket 24 by lifting it vertically to clear the detents 25, then pulling it outward from the shelf 99. The desired flange 18 along the length of the mounting flange 13 is then chosen and the mounting flange 13 is reinserted into the sign bracket 24 and lowered so that the detents 25 abut and retain the flange 18.

When mounted onto shelves 99, the housing 10 presents a first face member 11 and a second face member 12, the first face member 11 visible in the aisle from one side of the housing 10 and the second face member 12 visible in the aisle from the other side of housing 10. The two face members 11 and 12 can be provided with various indicia or indicia panels affixed to the face members 11 and 12, and as shown each may comprise a large interchangeable indicia panel 43, which as shown is mounted within opposing panel receiving members 16, which may comprise raised tabs or be formed as a generally U- or C-shaped channel members or the like suitable for receiving and retaining a thin, sheet-like member imprinted with indicia. As shown in FIG. 1, the interchangeable indicia panel 43 is removable from the panel receiving members 16 by sliding it vertically. Any combination of single or multiple fixed or interchangeable indica panels may be provided on the face members 11 and 12.

Figure 3:
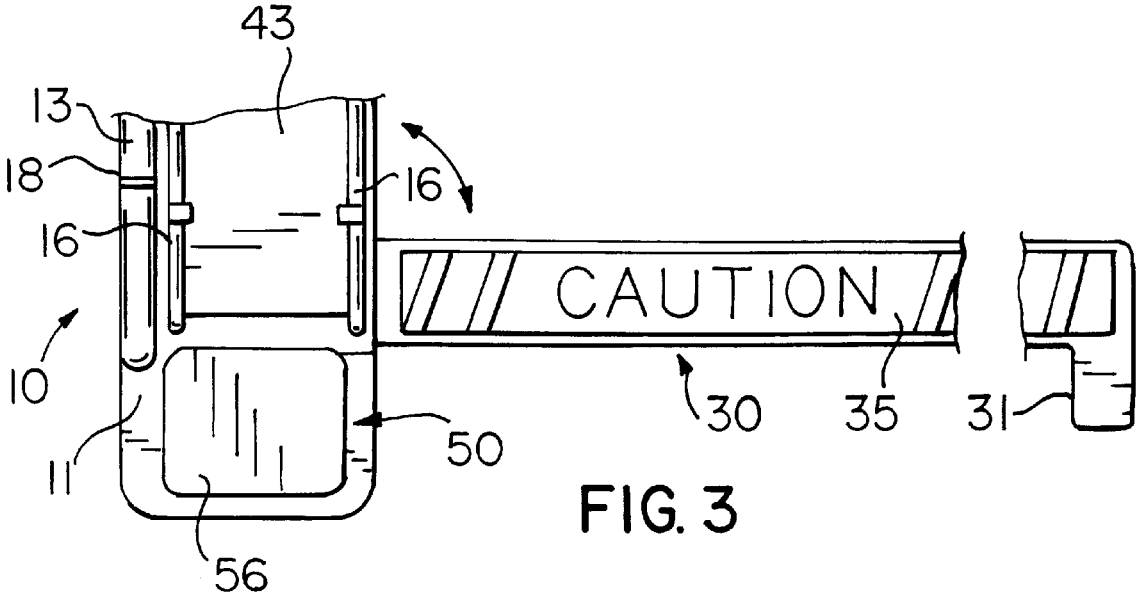
FIG. 3 is a partial side view of the invention, with the warning arm extended from the pocket.

The combination of the two opposing face members 11 and 12 define a vertically disposed pocket 17 which extends perpendicularly from the front edge or face of the shelving 99 and has a lateral opening on the side opposite the mounting flange 13, and which receives and retains a warning arm member 30. Warning arm 30 is pivotally connected at its base to housing 10 by a pivot means 32, such as a pin or bolt connected to a pivot base 34, as shown in FIG. 2. When the warning arm 30 is positioned vertically, the bulk of the warning arm 30 resides within the pocket 17, such that warning arm 30 is not visible to customers. A tab 31 is preferably provided at the free end of the warning arm 30, tab 31 extending a short distance from pocket 17 when the warning arm 30 is in the hidden position, as shown in FIG. 1. Tab 31 provides an easy way to grasp and pivot the warning arm 30 out of the pocket 17. It would also be possible to provide one or both face members 11 and 12 with a laterally extending recess to allow the free end of the warning arm 30 to be grasped without need for an extending tab 31. Warning arm is a generally thin, but relatively stiff or rigid member, which comprises a first warning face 35 and a second warning face 36, which are provided with cautionary indica such as hazard warning patterns, cautionary words, or both. When it is necessary to warn of a hazardous condition, the warning arm 30 is pulled from the pocket 17 of housing 10 and pivoted into the generally horizontal position, as shown in FIG. 3, such that it extends laterally away from the shelves 99 and into the aisle. Both warning faces 35 and 36 are now visible, one from each direction of approach down the aisle. When the hazardous conditions have been rectified, the warning arm 30 is pivoted back into the pocket 17.

Figure 4:
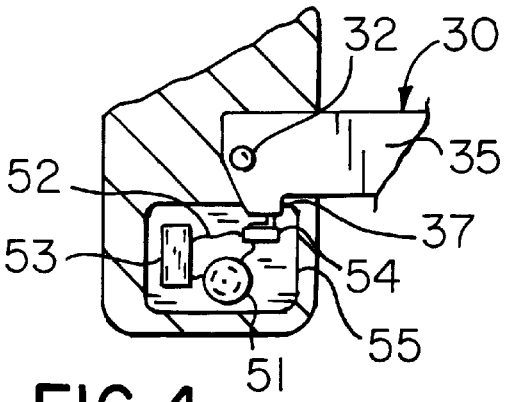
FIG. 4 is a exposed view of the a portion of the housing, showing the power recess.

It is also possible to provide the device with one or more signal means 51 mounted onto the warning arm 30, on or within the housing 10, as shown in FIG. 4, or both. Signal means 51 may comprise a visible warning indicator, such as a blinking light, or an audible warning indicator, such as a bell, beep, voice message or the like, which is connected by conductor wire means 52 to a power source means 53, such as a battery mounted within a power means recess 55 in power chamber 50, which preferably has a removable cover 56. The signal means 51 is activated by an activation means 54, such as a switch or contact plates 54, preferably mounted within power means recess 55 whereby the signal means 51 is only activated when the warning arm 30 is pivoted into the horizontal position. As shown, the warning arm 30 may be provided with an actuator shoulder 37 for contacting the actuator means 54 when the arm 30 is disposed in the horizontal position. Likewise, additional passive warning devices, such as other hanging panels, streamers, sheets, etc. could be attached to the warning arm 30, provided that all such additional devices can be stored within pocket 17 when the warning arm 30 is retracted.

It is contemplated that certain equivalents and substitutions for various elements outlined above may be obvious to those skilled in the art. The true scope and definition of the patent therefore is to be as set forth in the following claims.

We claim:

1. A hazard warning sign for attachment to a horizontally disposed shelf having a front edge, the sign comprising:

(A) a generally vertically disposed housing having a generally extended vertical dimension, a relatively shorter lateral dimension, and a thin thickness dimension, said housing comprised of a first face member and a second face member which together define a generally vertically disposed pocket there between to receive a warning arm;

(B) shelf mounting means attached to said housing for mounting said housing onto the front edge of the shelf such that said housing extends generally perpendicular to the front edge of the shelf, where said shelf mounting means comprises a sign bracket attached to said housing and a shelf bracket attachable to the shelf, said sign bracket and said shelf bracket joined by a hinge member; and (C) a warning arm pivotally connected to said housing, said warning arm positionable in both a vertical and a horizontal position, where said warning arm is disposed within said pocket in said vertical position and is extended laterally from said pocket in said horizontal position.

2. The sign of claim 1, where said hinge member has a pivot axis which is inclined from true vertical when said mounting means is mounted on the shelf.

3. The sign of claim 2, where said hinge member pivot axis is inclined approximately 20 degrees from true vertical.

4. The sign of claim 1, where said housing has a generally vertically extending mounting flange received by said sign bracket and said hinge member has a pivot axis which is inclined relative to said mounting flange such that said housing can pivot from the position generally perpendicular to the shelf front edge.

5. The sign of claim 4, where said hinge member comprising means to allow said housing automatically returns to the position generally perpendicular to the shelf front edge when any force pivoting said housing from the generally perpendicular position is removed.

6. The sign of claim 1, where said sign bracket is generally U-shaped in cross-section.

7. The sign of claim 6, where said housing further comprises a generally vertically extending mounting flange generally circular in cross-section, said mounting flange having a number of support flanges extending therefrom, where said sign bracket receives said mounting flange and one of said support flanges is seated atop said sign bracket.

8. The sign of claim 7, where said sign bracket further comprises a pair of detents extending upward from said sign bracket which abut said one of said mounting flange support flanges to preclude separation of said mounting flange from said sign bracket in the direction perpendicular to said shelf front edge.

9. The sign of claim 1, further comprising signal means chosen from the group consisting of audible signal means and visible signal means.

10. The sign of claim 9, where said signal means activate automatically when said warning arm is disposed from said pocket.

11. A hazard warning sign in combination with a horizontally disposed shelf having a front edge, the sign comprising:

(A) a generally vertically disposed housing having a generally extended vertical dimension, a relatively shorter lateral dimension, and a thin thickness dimension, said housing comprised of a first face member and a second face member which together define a generally vertically disposed pocket therebetween to receive a warning arm;

(B) shelf mounting means attached to said housing for mounting said housing onto the front edge of the shelf such that said housing extends generally perpendicular to the front edge of the shelf, where said shelf mounting means comprises a sign bracket attached to said housing and a shelf bracke attachable to the shelf, said sign bracket and said shelf bracket joined by a hinge member; and (C) a warning arm pivotally connected to said housing, said warning arm positionable in both a vertical and a horizontal position, where said warning arm is disposed within said pocket in said vertical position and is extended laterally from said pocket in said horizontal position.

12. The sign of claim 11, where said hinge member has a pivot axis which is inclined from true vertical when said mounting means is mounted on the shelf.

13. The sign of claim 12, where said hinge member pivot axis is inclined approximately 20 degrees from true vertical.

14. The sign of claim 11, where said housing has a generally vertically extending mounting flange received by said sign bracket and said hinge member has a pivot axis which is inclined relative to said mounting flange such that said housing can pivot from the position generally perpendicular to the shelf front edge.

15. The sign of claim 14, where said hinge member comprising means to allow said housing automatically returns to the position generally perpendicular to the shelf front edge when any force pivoting said housing from the generally perpendicular position is removed.

16. The sign of claim 11, where said sign bracket is generally U-shaped in cross-section.

17. The sign of claim 16, where said housing further comprises a generally vertically extending mounting flange generally circular in cross-section, said mounting flange having a number of support flanges extending therefrom, where said sign bracket receives said mounting flange and one of said support flanges is seated atop said sign bracket.

18. The sign of claim 17, where said sign bracket further comprises a pair of detents extending upward from said sign bracket which abut said one of said mounting flange support flanges to preclude separation of said mounting flange from said sign bracket in the direction perpendicular to said shelf front edge.

19. The sign of claim 11, further comprising signal means chosen from the group consisting of audible signal means and visible signal means.

20. The sign of claim 19, where said signal means activate automatically when said warning arm is disposed from said pocket.

* * * * *